US008506288B2

(12) United States Patent
Epelbaum et al.

(10) Patent No.: US 8,506,288 B2
(45) Date of Patent: Aug. 13, 2013

(54) METHOD AND MEANS FOR IMPROVING COMBUSTION EFFICIENCY

(76) Inventors: Shaul S. Epelbaum, Washington, DC (US); Jerry C. Trippe, Fairfax Station, VA (US)

( * ) Notice: Subject to any disclaimer, the term of this patent is extended or adjusted under 35 U.S.C. 154(b) by 1175 days.

(21) Appl. No.: 12/321,793

(22) Filed: Jan. 26, 2009

(65) Prior Publication Data

US 2010/0190120 A1 Jul. 29, 2010

(51) Int. Cl.
*F23D 11/44* (2006.01)

(52) U.S. Cl.
USPC ..... 431/11; 431/4; 431/207; 44/335; 44/336; 44/400; 44/389

(58) Field of Classification Search
USPC ..... 431/11, 207, 4; 44/335, 336, 400, 44/389
See application file for complete search history.

(56) References Cited

U.S. PATENT DOCUMENTS 2,639,275 A * 5/1953 Vickers ..... 523/324
3,814,563 A * 6/1974 Slaby et al. ..... 425/203
4,789,383 A 12/1988 O'Mara et al.
4,826,728 A 5/1989 O'Mara et al.
4,837,249 A 6/1989 O'Mara et al.
5,906,665 A 5/1999 Trippe
6,702,568 B1 * 3/2004 Park ..... 431/4
6,746,522 B2 6/2004 Trippe
2006/0242894 A1 * 11/2006 Waters et al. ..... 44/459

OTHER PUBLICATIONS

Donel R. Olson et al, "Reduction of Heavy-Duty Diesel Engine Emissions Using a High Molecular Weight Polymer Fuel Additive", SAE Publication No. 2007-01-3981.

* cited by examiner

*Primary Examiner* — Avinash Savani
(74) *Attorney, Agent, or Firm* — Roland H. Shubert

(57) ABSTRACT

A more complete combustion and a decrease in particulate emissions in the burning of a heavy fuel oil in an industrial boiler or similar combustion device is obtained by first heating the oil to a temperature sufficient to significantly lower its viscosity and continuously mixing a fuel additive containing a solution of a high molecular weight, substantially linear, viscoelastic polymer to the heated oil flowing to the combustion device by mechanically stirring the oil and additive at conditions that do not cause degradation of the viscoelastic polymer through rupture and breakage of polymer molecules.

16 Claims, 1 Drawing Sheet

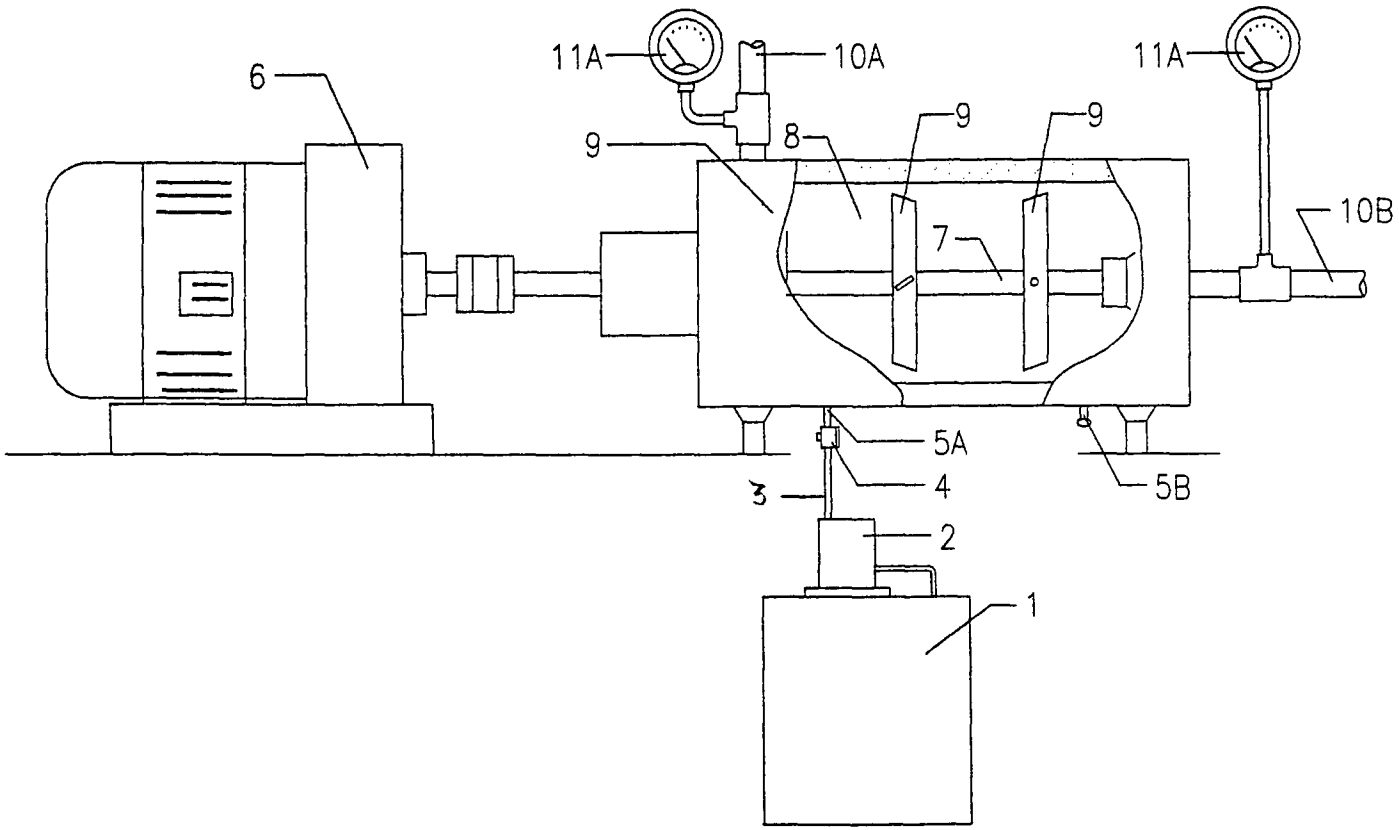
10B
11A
9
9
7
10A
8
11A
9
6
5B
5A
4
2
1
3

METHOD AND MEANS FOR IMPROVING COMBUSTION EFFICIENCY

BACKGROUND OF THE INVENTION

1. Technical Field

This invention relates generally to a method for improving the efficiency obtained in the burning of a heavy fuel oil in a boiler or other combustion device and to methods and means for preparing the fuel oil for combustion.

More specifically, this invention relates to a method for improving the combustion efficiency of a heavy fuel oil by mixing an effective amount of a combustion enhancing material comprising a high molecular weight, viscoelastic polymer to a heated fuel oil just prior to its combustion.

This invention further relates to a means for producing a homogeneous mixture of a heavy fuel oil and a viscoelastic polymer without degradation of the polymer or interfering with normal operations of the combustion device 2. Description of Related Art It is well known that the addition of a low concentration of a long chain, high molecular weight, hydrocarbon polymer to a liquid hydrocarbon can result in significant changes to the flow behavior of the resulting solution. If the hydrocarbon polymer has a sufficiently high molecular weight, of at least about 2.5 million daltons, then the resulting solution will exhibit viscoelasticity, displaying both viscous and elastic characteristics when undergoing rapid flow or other deformation. Low concentrations of relatively high molecular weight polymers, particularly such polymers as polyisobutylene, are known to reduce turbulence and have been used as drag reducing agents in pipelines, see for example, U.S. Pat. No. 4,837,249. These same polymers are also known to impart anti-misting properties to jet fuels to reduce flammability of fuel sprays occurring during aircraft crashes, see for example, U.S. Pat. No. 4,789,383.

High molecular weight hydrocarbon polymers, especially those substantially linear polymers such as polyisobutylene, have also found use as a fuel modifying agent for gasoline and diesel engines. As is described in U.S. Pat. No. 5,906,665, a high molecular weight polyisobutylene is first dissolved by extended gentle stirring in a petroleum solvent such as isooctane to obtain a stock solution containing about 2% polyisobutylene. That stock solution can then added directly at the time of refueling to the fuel tank of a vehicle where it readily dissolves. Substantial improvements in fuel consumption and acceleration were observed.

The effect of adding a high molecular weight hydrocarbon polymer, in this case polyisobutylene, on diesel engine performance was also extensively tested and the results reported in SAE Publication No. 2007-01-3981. As reported in that paper, the addition of about 5 ppm of the polyisobutylene agent to the fuel burned in several different commercial (Cummins, Caterpillar and Detroit) diesel engines resulted in a reduction in exhaust particulate matter on the order of 20% to 50% while also reducing $NO_x$ on the order of 5% to 25%. In some cases, fuel economy was also improved upon use of the polymer additive.

Attempts have also been made to improve the combustion efficiency of stationary industrial boilers burning heavy fuel oils by adding polymeric fuel modifying agents to the heavy fuel oil prior to combustion. Those attempts have met with failure in that no measurable increase in combustion efficiency could be observed.

This invention provides a technique for successfully employing a polymer additive to increase the combustion efficiency of a boiler or other combustion device burning heavy fuel oils and provides means for practicing that technique.

Other features and advantages of this invention are set out in the following description of the presently preferred embodiments of the invention.

SUMMARY OF THE INVENTION

More complete and efficient combustion of a viscous heavy fuel oil in a boiler or other combustion device is obtained by heating a feed stream of oil supplied to the boiler to a temperature at which its viscosity is lowered sufficiently to obtain efficient atomization, and mixing an effective amount of a high molecular weight, long chain, viscoelastic polymer to the heated oil through carefully controlled mechanical mixing at conditions that avoid degradation of the polymer at a location just before introduction of the oil into the combustion device.

BRIEF DESCRIPTION OF THE DRAWING

The sole FIGURE is a partially broken-away view of a preferred means for carrying out the process of this invention.

DESCRIPTION OF PREFERRED EMBODIMENTS OF THE INVENTION

It has been well established that solutions of high molecular weight, linear hydrocarbon polymers, when added to gasoline or diesel fuel, increase the efficiency of an internal combustion engine in which the fuel is burned and also reduce pollutants in the exhaust emissions. Polymeric fuel additives known to be employed in the prior art typically comprise a dilute solution of polyisobutylene or other substantially linear polymer having a molecular weight of at least about 2.5-3 million daltons. The fuel additive is simply poured into a vehicle fuel tank at the time of refueling in an amount sufficient to provide the desired polymer concentration in the fuel. Alternatively, the fuel additive may be added to larger volumes of fuel at a fuel depot or other distribution facility. Simple mixing such as occurs during transport of bulk fuel is sufficient to obtain a uniform solution of the polymer in the fuel.

It has been postulated, as for example in U.S. Pat. No. 5,906,665, that the beneficial effects of the polymer additive on the performance of gasoline and diesel engines result from physical, rather than chemical, factors. Specifically, the viscoelastic effect of the dissolved polymer is believed to be related to the suppression of sub-50-micron droplets produced by the injection of fuel into the cylinder of an engine resulting in a more homogeneous fuel spray. It is believed that the viscoelastic polymer increases the momentary, or extensional, viscosity of the fuel droplets under the conditions of very rapidly changing pressures and temperatures existing in the cylinder of an operating engine. That momentary increase in fuel droplet viscosity retards the vaporization and resulting fractional distillation of fuel droplets resulting in a more homogeneous final fuel and air mixture and an improvement in overall combustion efficiency.

Heavy fuel oil, that is, Nos. 5 and 6 fuel oils (which are also often called Bunker C and Residual fuel oil) is commonly used to power industrial boilers and large diesel engines. It would seem that use of the same polymer additive that is successfully employed with gasoline and diesel fuel should also result in improved combustion efficiency were it to be used with heavy fuel oil. The inventors conducted a series of experiments to test that hypothesis and to determine whether the viscoelastic fuel additive that was successfully employed in internal combustion engines burning gasoline and diesel fuel would affect the combustion efficiency of combustion devices burning heavy fuel oil, A first experiment was patterned after the procedures described in U.S. Pat. No. 5,906,665 and employed the same ultra-high molecular weight solution of polyisobutylene as the test additive. The test was conducted at a plant that uses a heavy fuel oil to power generators. The plant stores fuel oil in a main storage tank that is maintained at ambient temperatures, typically around 25° C. Fuel oil from the main storage tank is passed to an intermediate tank where it is warmed to a temperature of about 50° C. prior to its transport to the burner nozzles. Simulating these conditions, a quantity of the fuel oil was placed in a beaker and heated to 50° C. and the polyisobutylene fuel additive was added to the heated oil in an amount sufficient to produce a polyisobutylene concentration in the fuel oil sample of about 5 ppm. The sample was then stirred by hand with a mixing paddle. The fuel additive solution puddled on the surface of the fuel oil and would not mix with it.

A second experiment was conducted at a plant that burns No. 6 Residual fuel oil to generate electricity. The plant has a main fuel oil storage tank, a "daily" tank holding about a day's oil use that is supplied by the main tank, and a small surge tank that supplies the burner nozzles. A heater is located just upstream of the surge tank and maintains the oil in the surge tank at about 120° C. A metering pump was arranged to inject a solution of the polyisobutylene fuel additive into the surge tank at a rate that would provide a polyisobutylene concentration in the fuel oil fed to the burner nozzles of about 5 ppm. The rate of fuel oil consumption as a function of electrical power produced was continuously monitored and recorded and was compared to historical data taken prior to the experiment. There was no change. Smoke samples from the boiler stack were periodically taken and opacity tests were conducted. Data taken during the experimental run were then compared to historical results. Again, there was no change.

A third experiment conducted at the same plant as was used in the second experiment and differed from the second experiment in the placement of the fuel additive metering pump. In this test, the polyisobutylene fuel additive was injected directly into the fuel supply line leading from the surge tank to the burner nozzles. Again, data as to fuel used as a function of electrical power produced was monitored and recorded as was smoke opacity. As with the second experiment, there was no change as compared to historical results.

A laboratory experiment was also performed in which a quantity of the viscoelastic polyisobutylene fuel additive used in the previous experiments was dyed red. The additive was continuously metered into a ¾ inch fuel line through which diesel fuel was flowing at the rate of 4 gallons per minute. The additive introduction point was immediately before the flowing liquid passed into a transparent, inline motionless mixer of the same diameter as the fuel line. The fuel additive formed continuous streamers as it passed through the mixer and did not dissolve in the diesel fuel as it passed through the mixer.

As a result of these tests, it was postulated that the experiments described above may have failed because homogeneous mixing and dissolving of the viscoelastic polymer additive in the heavy fuel oil was not achieved prior to the combustion of the oil. There were considered to be a number of possible reasons for this failure to achieve homogeneous mixing. First, there are inherent difficulties in blending a small volume of a first liquid with a large volume of a second liquid. Second, there are large differences in physical properties, particularly differences in viscosity and in specific gravity, between the fuel additive and the heavy fuel oil that contribute to mixing difficulties. Third, the long chain polyisobutylene polymer molecules are easily degraded by chain breakage under high shear forces leading to a diminution or loss of viscoelastic properties, and that consideration alone precludes the use of any form of intense physical mixing. Lastly, the nature of viscoelastic liquids is to hold together and resist dispersion when subjected to shear forces which, in turn, inherently complicates any form of mechanical mixing with another fluid.

Based upon these considerations, applicants designed and tested a mixing system that avoids the problems that were discovered in conventional approaches to the mixing of these two unlike fluids, and that mixing system is diagrammatically illustrated in the FIGURE. Turning now to that FIGURE, the mixing system of this invention employs a reservoir or tank 1 containing a supply of a fuel additive that comprises a viscoelastic solution of a very high molecular weight polymer dissolved in a light hydrocarbon solvent. A metering pump 2 delivers a stream of fuel additive at a defined rate through tube 3 and check valve 4 for entry into a mixing chamber 8 by way of tube 5A. Mixing chamber 8 preferably comprises an elongated cylinder having an axial shaft 7 extending the length of the chamber and arranged to be rotated by means of a gear motor 6. A plurality of vanes or paddles 9 extend radially from the shaft and are disposed at an angle to a transverse plane of the mixing chamber so as to urge axial flow of a fluid within the chamber.

A metered stream of heavy fuel oil enters the mixing chamber by way of inlet 10A at a location adjacent the chamber end whereat the fuel additive enters the chamber. The fuel oil stream is metered into the mixing chamber at the rate it is to be burned, and is preheated to a sufficiently elevated temperature so as to reduce its viscosity to a level at which it can be efficiently atomized by the burner nozzles or injector means. Because of the high viscosity of heavy fuel oil at ambient temperatures, it is necessary to heat the oil to a relatively high temperature, i.e., at least about 50° C., and usually to a temperature in the range of 90° to 150° C., to achieve satisfactory atomization and mixing. The pre-heated heavy oil and the fuel additive streams are gently mixed by action of the rotating paddles 9 as the fluids traverse the length of the mixing chamber, through exit conduit 10B, and then to the burner. Pressure gauges 11A and 11B desirably are located at the fuel oil inlet and outlet respectively.

It is critical to the successful use of this invention that the described mixing system meets specific design and operation criteria. In particular, the volume of the mixing chamber must provide a sufficient residence time of the heavy oil and fuel additive within the chamber so as to thoroughly mix and dissolve the fuel additive in the heavy oil without any significant degradation of the polymer that would reduce its viscoelasticity and effectiveness. The required mixing chamber volume is, of course, directly dependent upon the rate of fuel oil flow and that in turn is determined by the requirements of the burner. Residence time is also affected by the viscosity of the heavy oil which, in turn, is a function of the fuel oil temperature. Residence time is also a function of the mixing intensity, or rotational speed of the paddles 9 as the long chain polymers of the fuel additive are shear sensitive in solution, and the longer the molecule the more sensitive it is to shear. It has been found through experimentation that the retention time within the mixing chamber must be at least about 5 seconds in order to obtain favorable results. It has also been found that little if any benefit is obtained at retention times greater than about 1.5 minutes.

The preferred fuel additive for use in this described system is a 0.5% to 5% solution of ultrahigh molecular weight polymer, most preferably polyisobutylene, dissolved in a light paraffinic hydrocarbon solvent. The fuel additive may be an even more dilute polymer solution, but very dilute solutions significantly and needlessly increase the cost. Polymer concentrations in the fuel additive greater than about 5% are not desirable in that they are increasingly viscous and difficult to dissolve in the fuel oil. When employing polyisobutylene the polymer must have a molecular weight of at least about 2.5-3.0 million daltons in order to obtain a significant improvement in combustion efficiency. Higher molecular weight polyisobutylenes are preferred as improvement in combustion efficiency produced by the additive improves markedly as the molecular weight increases. A most preferred polyisobutylene additive has a molecular weight of 5.3 to 7.0 million daltons. It has been determined through experimentation that polymer chain breakage with consequent reduction in viscoelasticity begins to occur at mixer velocities relative to the fluid of about 250 ft per minute or greater. Preferably, that relative velocity is limited to less than about 200 feet per minute. In the mixing system described, the greatest point of shear is at the tips of the paddles or blades 9 as the paddle tips are moving through the liquid at the highest velocity. In a rotating blade mixer of the kind described, the rotational speed of the paddle assembly is directly related to the diameter of the mixer blades. Consequently, the rotational speed of the paddle assembly must be limited so that the velocity of the paddle tips relative to the liquid does not exceed the level at which significant polymer chain breakage occurs.

The concentration of viscoelastic polymer in the fuel oil fed to the boiler may be in the range of 0.1 ppm to 25 ppm, and is desirably in the range of about 0.5 ppm to 10 ppm. Little, if any, combustion improvement is observed at polymer levels at or below 0.5 ppm and ordinarily the beneficial effect of the polymer additive reaches a substantially constant level at polymer concentrations at or below 10 ppm.

Results that were obtained in the course of an extended test evaluation of the described system are set out in the following examples.

Example 1

A mixing device was constructed generally in accordance with that illustrated in the FIGURE for use in a field test of the system. The internal diameter of the mixing chamber was 3 inches and its length was 12 inches, thus providing a chamber volume of approximately 85 cubic inches. The device had three sets of mixing blades, each set being 2 inches in diameter.

The test was conducted at a textile plant that had two identical 200 HP boilers burning No. 6 Residual fuel oil. Fuel was supplied to the two boilers from a single, heated, 1000 gallon day tank that was arranged to measure fuel usage, and to supply either one, or both, of the two boilers. Steam generated by each of the boilers was fed to a common accumulator. The described mixing device was installed in the fuel line of a first of the boilers at a location after the day tank but before the boiler while the fuel line of the second boiler ran directly from the day tank to the boiler.

Historical data gathered over a boiler run time of about 272 hours at full capacity showed fuel usage of each of the boilers to be approximately 27.3 gallons per hour. That usage rate was then considered to be a base line to use for comparison to further tests. A viscoelastic fuel additive that consisted of a 2% solution of a polyisobutylene polymer having a molecular weight of 6.3 to 7.0 million daltons dissolved in a light hydrocarbon solvent was then metered into the mixing device that was installed in the fuel line of the first boiler at a rate of 1 ounce per 30 gallons of fuel oil where it was mixed with an incoming stream of the heavy fuel oil heated to a temperature of 90° C. to give a resulting polyisobutylene concentration in the exiting fuel oil of approximately 5 ppm. The residence time of the oil in the chamber was approximately 45 seconds.

A series of combustion runs employing the first boiler burning heavy fuel oil containing the polyisobutylene fuel additive were then conducted. The combustion runs ranged in length from 131 to 262 hours and totaled 1,150 hours. Fuel consumption averaged 21.0 gallons per hour over the total test period. That amounts to a reduction in fuel consumption of about 23% from the base line usage rate.

In normal operation, without use of the fuel additive, the smoke exhausting the boiler stack was noticeably dark. When the fuel additive-treated oil was burned, the boiler smoke exhaust changed to almost clear in less than an hour after commencement of fuel additive use thus providing visual evidence of more efficient combustion.

Example 2

This test employed a diesel-electric generator burning No. 6 Residual fuel oil to produce electricity for an industrial plant. The same mixing apparatus and the same polymer additive used in Example 1 were employed in this test. A fuel oil stream heated to a temperature of 120° C. was continuously fed into the mixing apparatus along with a stream of the polymer additive. The polymer additive was fed into the mixing apparatus at a rate of 1 ounce per 30 gallons of fuel oil to give a polymer concentration in the fuel oil stream exiting the mixing apparatus of approximately 5 ppm, and the residence time of the fuel oil in the mixing apparatus was approximately 7 seconds. An 18.6% reduction in fuel consumption per kilowatt hour of electricity produced was observed when the diesel-electric generator operated with the additive-treated fuel oil.

Although the Example was directed specifically to a fuel additive comprising a solution of polyisobutylene, other substantially linear hydrocarbon polymers may be employed as well provided that those polymers have a sufficiently high molecular weight to impart viscoelastic properties to the heavy fuel oil at very low concentration. Many other variations in the mixing system and dissolving conditions that are set out in this disclosure will become apparent to others skilled in the art, and such variations are specifically included within the scope of this invention.

The invention claimed is:

1. A method for homogeneously blending a viscoelastic fuel additive solution into the fuel system of a combustion device burning heavy fuel oil comprising:

continuously introducing an effective amount of the fuel additive solution, said additive comprising a substantially linear, hydrocarbon polymer having a molecular weight greater than about 2.5 million daltons, into a stream of said heavy fuel oil at a point in the fuel system after the fuel oil has been heated for injection into the combustion device;

mechanically mixing said fuel additive with the heated fuel oil for a time sufficient for the additive to substantially completely dissolve in the oil at conditions that avoid any significant decrease in the viscoelasticity of the fuel additive; and thereafter injecting the mixed stream of fuel oil and additive into the combustion device.

2. The method of claim 1 wherein said heavy fuel oil is selected from the group consisting of Nos. 5 and 6 fuel oils, Bunker C, and Residual fuel oils.

3. The method of claim 2 wherein said stream of heavy fuel oil is heated to a temperature in the range of 50° C. to 150° C.

4. The method of claim 1 wherein said hydrocarbon polymer is polyisobutylene that is dissolved in a light hydrocarbon solvent.

5. The method of claim 4 wherein said polyisobutylene polymer has a molecular weight in the range of 5.3 to 7.0 million daltons.

6. The method of claim 5 wherein the polyisobutylene concentration in said solvent is in the range of 0.5% to 5.0%.

7. The method of claim 1 wherein the viscoelastic fuel additive is mixed with the heavy fuel oil by means of paddles, each paddle having a tip end and an attachment end that is fixed to a rotating shaft.

8. The method of claim 7 wherein the linear velocity of said tip end does not exceed 250 feet per minute.

9. The method of claim 7 wherein the fuel additive is mixed with the heavy fuel oil for a time of at least 5 seconds.

10. The method of claim 1 wherein the amount of viscoelastic additive that is mixed with the heavy fuel oil is sufficient to provide a polymer concentration in the fuel oil ranging from 0.5 ppm to 10 ppm.

11. A method for producing a cleaner burning heavy fuel oil comprising:

heating a stream of heavy fuel oil to a temperature in excess of about 50° Celsius;

providing a cylindrical mixing chamber, said chamber having a first end and a second end;

passing said heated oil stream into a first end of said cylindrical mixing chamber, said mixing chamber having a plurality of paddles mounted on an axially aligned shaft extending the length of said chamber from said first chamber end to said second end, said shaft arranged to rotate at a controlled rate;

metering a liquid fuel additive into said chamber adjacent said first chamber end, said fuel additive comprising a solution of a high molecular weight, substantially linear, viscoelastic polymer, the rate at which said fuel additive is metered into said chamber being sufficient to provide a concentration of said viscoelastic polymer in said fuel oil of at least about 0.5 ppm;

rotating said shaft at a rate that maintains the tip speed of said mounted paddles at a velocity less than 250 feet per minute;

adjusting the flow rate of said heavy oil stream relative to the volume of said mixing chamber so that the average retention time of fuel oil in the mixing chamber is at least 5 seconds;

withdrawing a stream of heavy oil, now containing said viscoelastic polymer dissolved therein, from a location adjacent said second chamber end; and passing said oil stream to a combustion device for burning.

12. The method of claim 11 wherein said heavy fuel oil is selected from the group consisting of Nos. 5 and 6 fuel oils, Bunker C, and Residual fuel oils.

13. The method of claim 11 wherein said viscoelastic polymer comprises a substantially linear, hydrocarbon polymer having a molecular weight greater than about 2.5 million daltons.

14. The method of claim 13 wherein said hydrocarbon polymer is polyisobutylene that is dissolved in a light hydrocarbon solvent.

15. The method of claim 14 wherein the polyisobutylene concentration in said solvent is in the range of 0.5% to 5.0%.

16. The method of claim 11 wherein the amount of additive that is mixed with the heavy fuel oil is sufficient to provide a polymer concentration in the fuel oil ranging from 0.5 ppm to 10 ppm.

* * * * *